US008201816B2

(12) United States Patent
Stauber

(10) Patent No.: US 8,201,816 B2
(45) Date of Patent: Jun. 19, 2012

(54) DEVICE AND METHOD FOR TAKING OVER FLEXIBLE, FLAT OBJECTS

(75) Inventor: Erwin Stauber, Grut (CH)

(73) Assignee: Ferag AG, Hinwil (CH)

( * ) Notice: Subject to any disclaimer, the term of this patent is extended or adjusted under 35 U.S.C. 154(b) by 214 days.

(21) Appl. No.: 12/719,431

(22) Filed: Mar. 8, 2010

(65) Prior Publication Data

US 2010/0230887 A1 Sep. 16, 2010

(30) Foreign Application Priority Data

Mar. 10, 2009 (CH) ..... 358/09
Jul. 20, 2009 (CH) ..... 1135/09

(51) Int. Cl.
*B65H 39/00* (2006.01)

(52) U.S. Cl. ..... 270/52.14; 270/52.16; 270/52.19; 270/52.23; 270/52.25; 271/315

(58) Field of Classification Search ..... 270/52.14, 270/52.16, 52.19, 52.23, 52.25; 271/315
See application file for complete search history.

(56) References Cited

U.S. PATENT DOCUMENTS

| | | | | |
|---|---|---|---|---|
| 4,124,203 | A | 11/1978 | Muller | |
| 6,065,746 | A | 5/2000 | Tranquilla | |
| 6,095,511 | A * | 8/2000 | Jager | 270/52.29 |
| 6,234,466 | B1 * | 5/2001 | Infanger | 270/52.23 |
| 6,691,996 | B2 * | 2/2004 | Kaya et al. | 270/52.25 |
| 6,830,241 | B1 * | 12/2004 | Klopfenstein | 270/52.25 |
| 7,422,203 | B2 * | 9/2008 | Muller et al. | 270/52.25 |

FOREIGN PATENT DOCUMENTS

| | | |
|---|---|---|
| DE | 195 25 168 | 1/1997 |
| DE | 103 11 858 | 8/2004 |
| DE | 10 2005 047 675 | 4/2007 |
| EP | 1 153 872 | 11/2001 |
| FR | 2 864 524 | 7/2005 |

* cited by examiner

*Primary Examiner* — Patrick Mackey
(74) *Attorney, Agent, or Firm* — Rankin, Hill & Clark LLP

(57) ABSTRACT

A device and a method for taking over flexible, two-dimensional objects (100), in particular printed products, at a take-over location (S1). The objects (100) are received by receiver units (10, 12). Controllable narrowing elements (20) are present, in order to prevent a squashing and rebounding of the objects (100) on or from an abutment of the receiver unit (10, 12), with which narrowing elements, in an active condition, the opening width (W2) of the receiver unit (10, 12) in a middle region between an entry opening (16) of the receiver unit (10, 12) and the abutment (15), may be reduced compared to an inactive condition. These are controlled with a control device (30). A more reliable positioning of the objects (100) in the receiver unit (10, 12), in particular at high feed speeds and with thin, elastically deformable objects (100), may be achieved.

19 Claims, 4 Drawing Sheets

10,12
14
16
13
50
23
30
31
32
33
22
17
20
15
200
W2
F2
W1
21
S1
F1
100

DEVICE AND METHOD FOR TAKING OVER FLEXIBLE, FLAT OBJECTS

BACKGROUND OF THE INVENTION

1. Field of the Invention

The invention lies in the field of conveying and further processing flexible, two-dimensional objects, in particular printed products. It relates to a device and to a method for taking over such objects, in particular printed products such as e.g. newspapers, magazines, brochures, catalogues, part-products of such printed products, or supplements, advertising material, cards, goods samples, CDs.

2. Description of Related Art

The further processing of printed products is carried out at ever increasing speeds. Moreover, more and more complex products are put together of several part-products and processed. Both of these, the high speeds and the complexity of the products, require a very accurate control of the product position at each point in time of the processing.

A process which occurs very often is the so-called insertion: one or more part-products (also called pre-products) are inserted into a folded or glued outer product (also called main product). The part-products to be inserted may be printed products or also other objects, e.g. supplements, advertising material, cards, goods samples, CDs.

The main product, for example, is transferred by a gripper conveyor to an insertion system, e.g. an insertion drum or a revolving system, before the insertion procedure. The insertion system has several receiver units in the form of pockets. The main products with the back, e.g. the fold edge or glued connection in front, are inserted into these and are braked at the pocket base acting as an abutment. The main product is subsequently opened and the further objects are inserted into the opened main product.

Moreover, from the CH application No. 00788/08 which has no prior publication, it is known to leave the folded main product in the gripper and to support it by way of a receiver unit during the insertion procedure, i.e. for as long as the gripper needs to be opened for the purpose or receiving the further product, wherein the receiver unit is formed by way of several co-moved support elements cooperating with one another, and is subsequently removed again.

With the known devices, the feed direction normally runs in a different direction than the further conveying by the receiver units. For the transfer, the singularised objects must be transferred into the moved receiver units within a very short time. For this reason, little space and time is available for the actual transfer. The objects are led with one edge in front, through an entry opening of the receiver unit, into this. Thereby, the objects are often subjected to very large (negative) accelerations and are stopped by an abutment of a receiver unit and aligned thereon. The sudden braking at the abutment may lead to the newly fed object, which has a certain intrinsic elasticity, being squashed at the abutment, deforming and rebounding opposite to the feed direction when relaxed. Thereby, it may be laterally dislocated. If it consists of several part-objects, these may also mutually dislocate and/or rotate on relaxing. This effect occurs above all with thin objects. The inaccuracies in the position of the object may lead to errors in the further processing chain and should therefore be avoided.

BRIEF SUMMARY OF THE INVENTION

It is therefore the object of the invention to specify a device and a method for taking over flexible, two-dimensional objects, in particular printed products, with which the mentioned disadvantages are avoided and a good control of the object position is ensured during the feeding into the receiver unit, in particular at high processing speeds.

The device, according to the invention, comprises at least one receiver unit, which may be moved past a take-over location. The receiver unit serves for taking over flexible, two-dimensional objects, in particular printed products, which are fed from a feed unit in a feed direction, at the take-over location. The receiver unit has an entry opening with an entry opening width measured transversely to the feed direction, as least one support surface for the surfaced support of the object, and at least one abutment for the object edge which leads in the feed direction. At least one controllable narrowing element is provided, with which, in an active condition, the opening width of the receiver unit, measured transversely to the feed direction, may be reduced in a middle region between the entry opening and the abutment, compared to an inactive position. A control device is present and set up such that the narrowing element in the region of the take-over location is brought into the active condition, i.e. the receiver element on passing the take-over location is narrowed at least briefly.

The method according to the invention comprises the following steps:

moving at least one receiver unit, which has an entry opening with an entry opening width measured transversely to the feed direction, comprises at least one support surface for the surfaced support of the object, and at least one abutment for the object edge leading in the feed direction, along a closed movement path past a take-over location;

co-moving a narrowing element with the receiver unit, at least in the region of the take-over location, wherein the narrowing element in an active position may reduce the opening width of the receiver unit measured transversely to the feed direction, in a region between the entry opening and the abutment, compared to in an inactive position, introducing the objects in the feed direction into the at least one receiver unit;

activating the narrowing element in the region of the take-over location by way of a control device.

By way of reducing the opening width of the receiver unit in the region between the abutment and the entry opening, one ensures that the two-dimensional objects, on hitting the abutment, are not deformed too greatly due to their flexibility. The objects may only bulge to the extent that the reduced opening width permits this. The potential energy which is stored in the elastically deformed object is therefore reduced compared to the case with an opening width which is not reduced. On relaxing the elastically deformed object, therefore less potential energy is available which may be converted into a movement opposite to the feed direction. An improved control of its position within the receiver unit is achieved by way of this, in particular with thin, elastically deformable objects and high feed speeds. The region in which the receiver unit is narrowed, preferably lies in the vicinity of the abutment, in particular, roughly in the region of a quarter to two thirds of the complete depth of the receiver unit, wherein the entry opening width is preferably not or not significantly reduced by way of the narrowing element.

The orientation of the objects on feeding is advantageously such that their surface normal is perpendicular to the feed direction. The abutment is orientated transversely to the feed direction. It may for example also be formed by a co-moved element or a folded product which has already been gripped. The feed direction as a rule is therefore in the plane of the object, and conveyor direction of the receiver units as a rule runs perpendicular to this in the region of the take-over location.

In one example of the invention, the receiver units are pockets, which comprise two side walls which are arranged preferably at an acute angle relative to one another, and a pocket base. The side walls act as support surfaces for the introduced objects, and the pocket base between the two support surfaces serves as an abutment.

The controllable narrowing element is an integral constituent of the receiver unit or co-moves with the receiver unit at least in the region of the take-over location.

The narrowing element, for example, has an active surface facing the inside of the pocket and whose shape and/or position relative to the support surfaces may be changed for changing the opening width. The opening width may be reduced at a predefined location of the support surface by way of the narrowing element, whilst it remains unchanged in other regions, in particular at the entry opening. This location for example, seen in the feed direction, lies roughly in the region of the front third to the front two thirds of the object bearing on the abutment. With respect to the pocket itself, the narrow location preferably lies in the region of one quarter to two thirds of the total depth. The opening width in the active condition is preferably two thirds of the opening width in the inactive condition or is yet smaller. In a preferred variant, it may be reduced to zero.

The narrowing element in one example of the invention is mounted on the pocket and is elastically deformable by way of cooperation with a control element. It may, for example, comprise an elastically deformable material strip, which in the inactive condition (no narrowing) bears on a support surface, and in the active condition is pushed away therefrom, for the purpose of narrowing the pocket at least regionally, e.g. amid the bulging and/or pivoting of the material strip.

The narrowing element is preferably mounted on one of the support surfaces, in a manner such that the support surface and the active surface merge into one another in a stepless (shoulderless) manner in the region of the entry opening, seen in the feed direction, so that a fed object may not get stuck. The active surface in a middle region of this has a variable, controllable distance to the support surface. The end region of the active surface facing the pocket base may be pivoted back behind the support surface in the inactive condition, or may be always located at the same location by way of a suitable mounting of the narrowing element.

In a further example of the invention, grippers are applied as narrowing elements, which at least in the region of the take-over location are moved synchronously with the receiver units. The grippers have a first and a second gripper jaw, whose position relative to one another may be changed for changing the opening width, for example in a manner known per se with a cam control. Here too, the opening width is preferably controlled such that it is reduced directly with the take-over of an object, compared to the case before the take-over. Subsequently, the gripper is preferably opened once again, so that the products may fall completely downwards, and/or for the lateral alignment.

The grippers, on entry into the take-over region, may already contain products and convey these. In this case, the receiver units are not led together with the grippers until in the take-over region, and in particular not until there are they formed of several cooperating support elements around the gripped product. They support the products already contained in the grippers, preferably on taking over at least one further object, for which the gripper must be opened. The product together with the fed object is subsequently conveyed further in the closed gripper. The grippers here therefore have a double function, specifically gripping and conveying the objects, as well as narrowing the receiver unit on feeding an object.

Preferably, the control device is designed such that the maximal narrowing is variable. With this, the narrowing may be set specific to a product, e.g. may be larger with thin objects than with thick ones. The control device, for example, has an adjustable control cam, with which a larger or a smaller narrowing maximal narrowing may be set, depending on the position.

In some cases, in particular if the object is to be inserted between product parts of a folded or glued product already contained in the receiver compartment, it may be advantageous to reduce the effective opening width "seen" from the object, in a region between the entry opening and the abutment, completely or essentially to zero. Preferably thereby, the inner surfaces of the already contained product in the narrowed condition bear directly on one another at a distance to the abutment. Their distance in the region of the entry opening is preferably not changed by the narrowing. An entry gap is therefore formed, which tapers in a wedge-like manner and in which the introduced objects get stuck and are gently braked. As soon as the object has reached the narrowed region, the narrowing element is deactivated. The object then slides to the abutment on account of the residual momentum or the gravity.

The invention may be realised on the basis of known take-over devices, in particular revolving systems or drum systems with several receiver units, which are moveable along an infinite or circular path. For example, the invention may be designed on the basis of pocket conveyors or gripper conveyors, cutting drums and likewise. As mentioned, the receiver units may also be realised by way of several cooperating support elements.

The feed unit may obtain objects from a storage means, e.g. stack, winding or from a moved formation, e.g. imbricate formation, flow of individual products, gripper flow. The fed objects may be simple objects, e.g. simple printed products or goods samples, or more complex collections, e.g. a small stack of different printed products lying on one another.

With regard to the method, the objects may be introduced into empty receiver units as well as in receiver units which already contain a product. In the second case, it is preferably the case of a folded printed product (main product), into which the fed object is inserted. The main product may also contain already inserted further products (part products).

The opening width may be increased again after passing the take-over location, for example, in order to align the objects in the receiver unit. This above all is of interest with grippers with a double function as narrowing elements as well as for further conveying, since the objects on gripping ideally should have a distance to the base of the gripper. Alternatively, the gripper may pass the take-over location in a half-closed (narrowed) condition and be completely closed directly after this without any renewed opening.

The invention has particular advantages with the transfer of objects from a stationary conveyor belt to receiver compartments, which are conveyed past the transfer location. As a rule, the objects lie individually behind one another on the conveyor belt. For this reason, with a given processing rate, 3-4 times greater feed speeds are necessary than with a more compact formation in the feed, e.g. with objects conveyed in a hanging manner by way of grippers. Moreover, the time widow, in which the opening of the receiver compartment runs past the stationary feed location and in which the transfer may therefore take place, is significantly smaller that in the case of a transfer from grippers which may be co-moved with the receiver compartments. The latter also necessitates large accelerations whose effects are advantageously alleviated by way of the invention.

BRIEF DESCRIPTION OF THE DRAWINGS

Examples of the invention are represented in the drawings and are described hereinafter. In a purely schematic manner are shown in.

DETAILED DESCRIPTION OF THE INVENTION

Figure 1A:
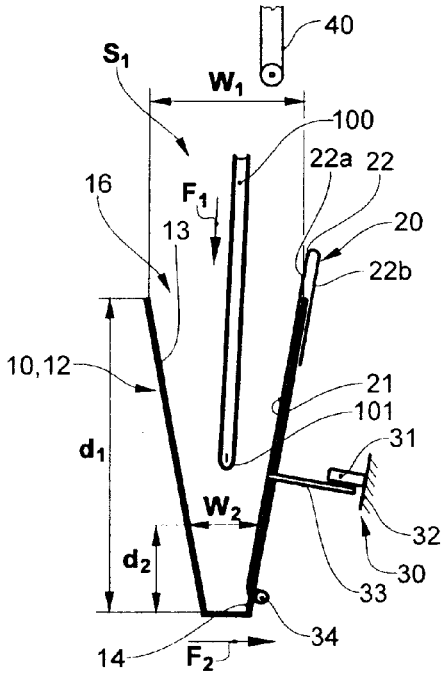
FIGS. 1*a-c* different momentary pictures on feeding an object to a receiver unit in the form of a pocket, with a narrowing element in the inactive condition.
Figure 1B:
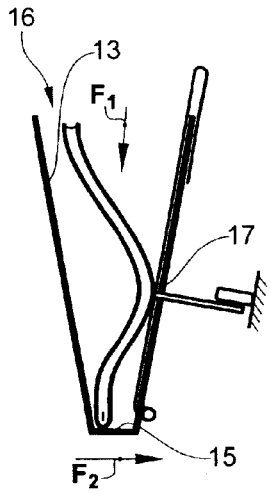
Figure 1C:
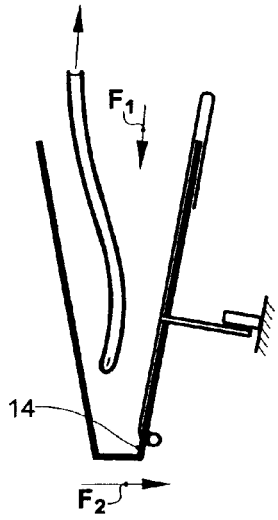

FIGS. 1*a-c* and 2*a-c* show a receiver unit 10 in the form of a pocket 12 at various points in time on feeding an object 100 in a feed direction F1 to a take-over location S1. The pocket 12 passes the take-over location S1 in a conveyor direction F2, which here is perpendicular to the feed direction F1. The pocket 12 comprises two plane, lateral support surfaces 12, 14, a pocket base acting as an abutment 15 and an entry opening 16. The pocket 12, moreover, comprises a controllable narrowing element 20 with an active surface 21. The narrowing element 20 is located in the inactive condition with FIG. 1*a-c*, in which its active surface 21 runs in the direct vicinity parallel to one of the support surfaces 14. With FIGS. 2*a-c*, the narrowing element 20 is in the active condition, i.e. is regionally lifted from the support surface 14 to the inside of the pocket or to the other support surface 13.

The pocket 12 has an opening width W1 in the region of the entry opening 16, which is distant to the pocket base 15. The total depth of the pocket 12 is indicated at d1. The opening width W2 is reduced in size with respect to this in the region close to the base. In the inactive condition of the narrowing element 20 (FIGS. 1*a-c*), the opening widths W1, W2 are determined by the distance of the two lateral support surfaces 13, 14 measured transversely to the feed direction F1. In the active condition of the narrowing element 20 (FIGS. 2*a-c*), the opening width W2 in the region close to the base is influenced by the narrowing element 20, whilst the opening width W1 in the region of the entry opening 16 remains constant. Here, the distance to the pocket base 15 is indicated at d2, with which the largest narrowing (smallest opening width W2) occurs in the active condition. This distance d2 is about one quarter to two thirds of a typical object length d, measured in the feed direction F1. d2 is about 0.25-0.67d1 with respect to the pocket 12. The opening width is, thus, manipulated in the lower region close to the abutment.

The narrowing element 20 is constructed as follows: it comprises an elastically deformable surfaced element 22, which in the proximity of the pocket base 15 is rotatably mounted on the here right support surface 14, about a pivot 34 running parallel to the pocket base 15. The surfaced element 22 comprises two part elements 22*a*, 22*b* which are connected to one another in a U-shaped manner. One of the part elements 22*a* in the inactive condition bears directly on the support surface 14. The other part element 22*b* from the view of the other support surface 13 is located on the other side of the support surface 14 assigned to it. The narrowing element 29 is displaceably mounted in the direction of the support surface 14 in the region of the entry opening 16 due to the U-shape. The side of the flat element 22 facing the inside of the pocket serves as an active surface 21 for narrowing the pocket 12. The flat element 22 consists, for example, of spring steel.

The control device 30 here, by way of example, comprises a stationary or movable control cam 32, which cooperates with a cam element 31, here in the form of a cam roller. The cam element 31 is coupled to the locking element 20, here to the part element 22*a*, via a coupling element 33, e.g. a rod.

The coupling element 33 thereby projects through an opening 17 in the support surface 14. A constant distance between the control cam 32 and the active surface 21 is set by way of the coupling element 33, in the region in which the coupling element 33 is connected to the surfaced element 22. The active surface 21 is, thus, deformed in dependence on the shape or the position of the control cam 32. An arch shape of the active surface 21 is realised by way of the part element 22*a* being displaceably mounted on the pivot 34 and displaceably mounted along the support surface 14 in the opposite region. This active surface runs essentially parallel to the support surface 14 in the region of the entry opening 16, curves up seen in the feed direction F1 and meets the support surface 14 again at an angle in the region close to the base. The opening width W2 is reduced by way of this, whereas the opening width W1 remains roughly the same.

The manner of functioning of the narrowing element 20 with FIGS. 2*a-c* in comparison to the inactive condition (FIGS. 1*a-c*) is described hereinafter. With FIGS. 1*a-c*, according to the state of the art, an object 100 with an edge 101, e.g. the back, in front, is introduced into the pocket 12 (FIG. 1*a*) in the feed direction F1. The feed plane here corresponds roughly to the plane of symmetry between the two lateral support walls 13, 14. The object 100 hits the pocket base 15 in an unbraked manner and thereby is deformed (FIG. 1*b*), by which means a part of its kinetic energy is stored as potential energy. It curves or squashes roughly so far as the opening width W2 of the pocket 12 in the region close to the base permits. At least a part of the energy contained in the deformation is converted into kinetic energy again due to the elasticity of the object 100, by way of the object 100 relaxing again, at least approximately stretching out and rebounding from the pocket base 15. This is represented in an exaggerated manner in FIGS. 1*a-c*.

Figure 2A:
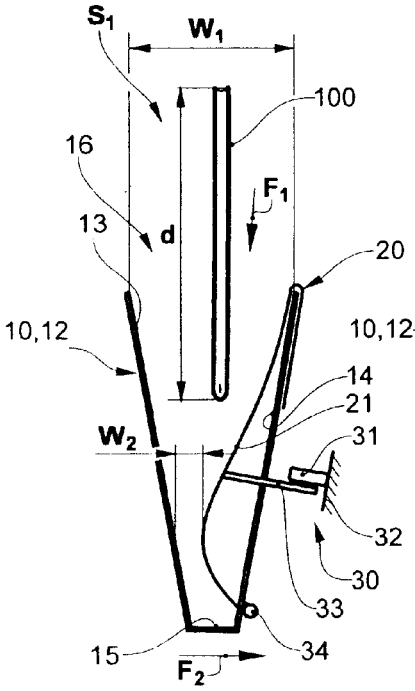
FIGS. 2*a-c* different momentary pictures on feeding an object to a receiver unit in the form of a pocket, with a narrowing element in the active condition.
Figure 2B:
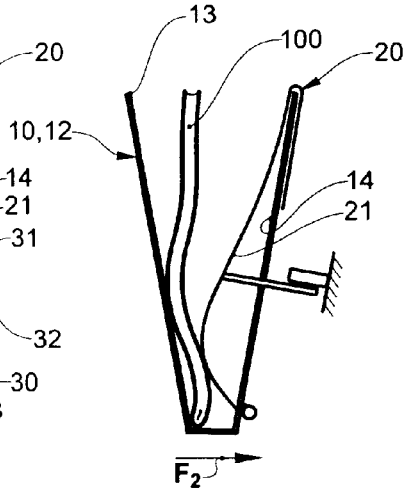
Figure 2C:
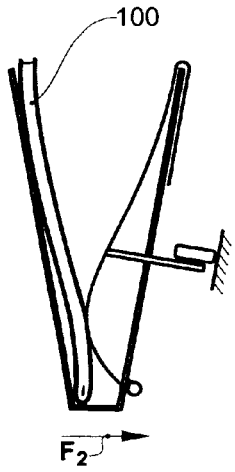
Figures 3A, 3B, 3C, 3D:
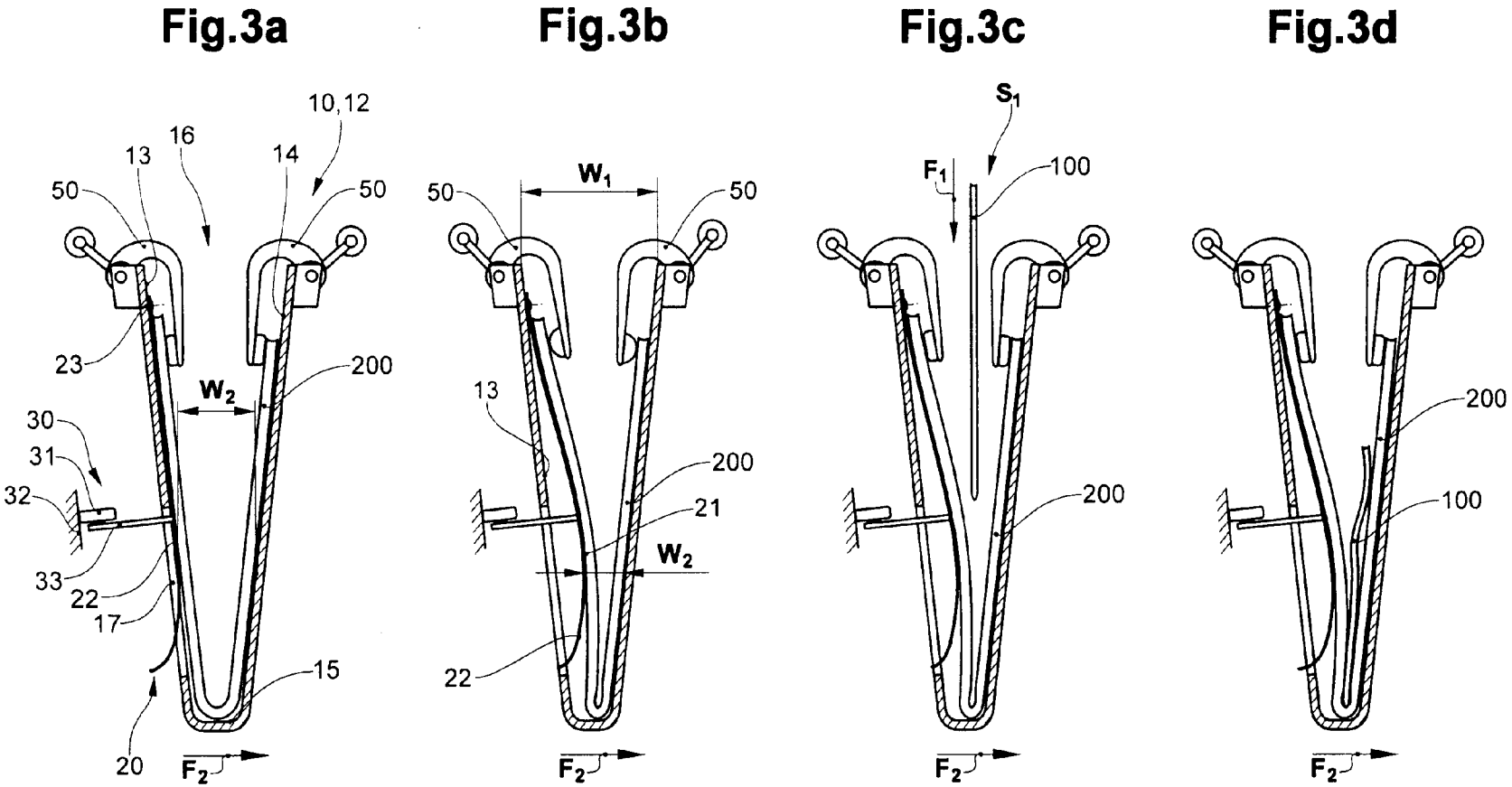
FIGS. 3*a-d* different momentary pictures on feeding an object to a receiver unit in the form of a pocket, with a controllable narrowing element, wherein a folded product is already located in the pocket.

With FIGS. 2*a-c*, the narrowing element 20 is set into the active condition directly before or on feeding the object 100. The opening width W2 of the pocket 12 in the region close to the base is significantly reduced by way of this, in particular roughly to a quarter or two thirds of the opening width W2 in the inactive condition. The object 100 thus passes an entry opening 16 which in size is not changed, with a width W1, and then slides along the active surface 21 to the pocket base 15. A strong curving of the object 100 is prevented by way of the narrowing, the potential energy is reduced and thus the rebounding is reduced. The object 100 is securely positioned in the pocket 12. This effect occurs independently of any surface nature of the active surface 21, and a high coefficient of friction is not necessary, but rather the active surface 21 may also be smooth.

The narrowing element 20 may be subsequently set back into the inactive condition, so that further processing steps may be carried out in the usual manner, e.g. opening the object, introducing further objects, cutting, aligning and/or further conveying. The narrowing element 20 also may be activated only when the edge 101 is already located in the pocket 12.

FIGS. 3*a-d* show a further example of a receiver unit 10 in the form of a pocket 12 with two support surfaces 13, 14, with a pocket base 15 and with a controllable narrowing element 20. Here, this is assigned to the support surface 13 which is on the left in the drawing. It comprises a surfaced element 22 which in the region of the entry opening 16 is connected in a fixed manner to the support surface 13 via a fastening element 23, so that the active surface 21 and the support surface 12 merge into one another in a stepless manner. The surfaced element 22 is arch-like. Its active surface 21 in the inactive condition (FIG. 3*a*) runs largely parallel to the support surface 13. Its end facing the pocket base 15 in the inactive condition projects through an opening 17 to the outside, said opening being larger in comparison to the opening in FIGS. 1*a-c*, 2*a-c* the outside. It is not necessary but possible for the surfaced element 22 to be elastically deformable over its entire extension.

The surfaced element 22 as with FIGS. 1*a-c*, 2*a-c* is connected to a control mechanism 30 comprising a cam roller 31, coupling 33, and control cam 32, for controlling the position of the active surface 21.

The pocket 12 in FIGS. 3*a-d* comprises controllable holding elements 50, which are located in the region of the entry opening 16. They serve for fixing a folded product 200, which is already located in the pocket 12, in this pocket 12, by way of clamping its edges distant to the pocket base 15, and also for keeping it open on introducing an object. One may also make do without these holding elements 50 in the case that a folded product 200 is not to be inserted.

As with FIGS. 2*a-c*, with FIGS. 3*a-d*, the opening width W2 in the region close to the base is reduced with respect to the actual distance of the two support surfaces 13, 14, shortly before or as soon as the take-over location S1 is reached. Thereby, the already taken-over product 200 bears on the support wall 14 or the active surface 21 at each point in time. After passing the take-over location S1, the narrowing element 20 is deactivated again and the initial (inactive) opening width W2 is restored again. Further processing steps may be connected in the usual manner, e.g. opening the object, introducing further objects, cutting, aligning and/or further conveying.

Figure 4A:
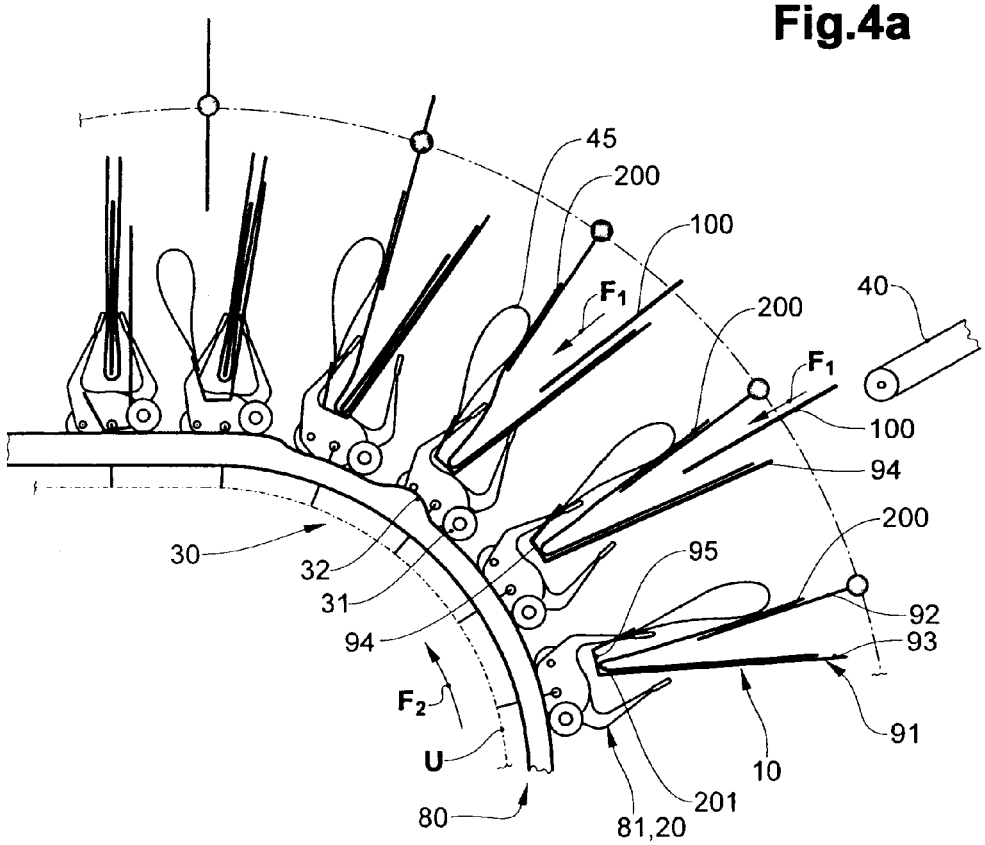
FIGS. 4*a+b* different momentary pictures on feeding an object to a receiver unit in the form of several support elements cooperating with one another and with a gripper with a controllable opening width as a narrowing element, wherein a folded product is already located in the gripper at the take-over location.

FIGS. 4*a+b* show a further example of a device according to the invention with grippers 81 as narrowing elements 20. The device corresponds essentially to the insertion device as has been described in the CH applications No. 00788/08 or 00358/09, which have no prior publication. The purpose of the insertion device is the insertion of objects 100 which may be individual ones or also a composition of several products, into a folded main product 200. Thereby, the main products 200 are lead up by a gripper conveyor 80. During the insertion procedure, the gripper 81 is opened, the product 200 however is not taken therefrom, but is only additionally supported by a receiver unit 10. After the insertion, the combined product 200, into which the object 100 has been inserted, is conveyed further by the same gripper 81, which is then closed again.

The device here has only been described to the extent as is necessary for the understanding of the invention on which this application is based.

The device comprises a plurality of receiver units 10 which are formed by way of the interaction of several first and second support elements 91, 92 which are movable to one another. The support elements 91, 92 are in each case moved along a closed revolving path U1, U2 and are movable relative to open another, so that in particular they may be pivoted away such that the grippers 81 may move further in an unhindered manner after introducing the objects 100 into the products 200.

The first support elements 91 in each case comprise a surfaced support wall 93 which merges into a U-shaped element 94. The U-shaped element 94 is located at the take-over location S1 roughly at the same location as the fold edges of the product 200 taken over by the grippers 81 or at a small distanced thereto. A product 200 is, thus, supported by the base 95 of the U-shaped element 94 and by the support wall 93, even if the gripper 91 is opened. An additional support function or holding-open function is achieved by the second support elements 92.

The first support elements 91, moreover, optionally comprise a holding element and/or braking element 45 in the form of a loop of an elastic material. The holding elements and/or braking elements 45 lie opposite the support wall 93 and are firmly connected to the U-shaped element 94.

The path U of the grippers 81 is at least partly concentric to the path of the receiver units 10 or the path U1, U2 of the first or second support elements 91, 92, for example in the region represented in FIG. 4. The revolving paths U, U1, U2 may subsequently part.

The function is explained hereinafter:

Products 200, here folded main products, are conveyed by way of the gripper conveyor 80. Whilst a product 200 is held by a gripper 81, the second support elements 91 move in between the product parts, in the lower part of the movement path U which is not represented here. They therefore hold the product 200 open. The first support elements 91 are pivoted in roughly simultaneously. The first support elements 91 assume a position, in which their bases 95 have a predefined distance to the gripped product edge 201. The product 200 is opened in this position, and the upper product part lies on the outer support elements 92. The holding elements and/or braking elements 45 press the upper product part against the outer support elements 92. The grippers 81, receiver units 10 and product 200 in this relative position are moved further in a synchronous manner up to the take-over location S1. An object 100 is inserted from a feed unit 40 in a feed direction F1, which runs perpendicularly to the base 95 and the movement direction of the receiver units 10. It pulls the product 200 already arranged in the receiver unit 100 and in the open gripper 81, inwards.

The grippers 81 here act as narrowing elements 20 according to the invention. The gripper 81 is completely opened shortly before the take-over location S1. The opening width W2 of the receiver units 10 in the region close to the base is therefore essentially determined by the distance of the elements 91, 94, and 45. The opening width W1 in the region of the entry opening 16 is determined by the distance of the elements 91 and 92. On reaching the take-over location S1, the grippers 81 are briefly partly closed (active condition). In this example, the position in which the control cam 32 has a small hump when partly closing the grippers, is located behind the take-over location S1 in the gripper movement direction, so that the gripper 81 is not partly closed until shortly after the take-over location S1. This is caused by the running time of the object from the station 40 up to the abutment of the receiver unit (the receiver unit is basically narrowed at the latest when the object reaches the narrowing location).

The opening width W2 is reduced by way of the partial closure. The same effect occurs as described above with reference to FIGS. 2*a-c*, 3*a-d*. A strong curving and rebounding of the objects 100 is avoided. After the insertion, the grippers 81 are again opened further, in order to laterally align the objects 100, 200 and/or be able to position them perpendicularly to the base 95.

The gripper 81 is subsequently closed. If no aligning or positioning function is required, the grippers 91 may also be closed directly after the introduction of the objects. The support elements 91, 92 which are now no longer necessary, for the supporting, are pivoted away to the top or bottom, so that the gripper conveyor 80 may be led out of the region of the support elements 92 and their mounting.

Figure 5E:
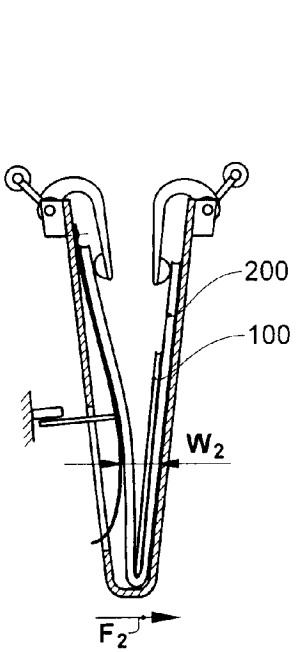
FIGS. 5*a-e* analogously to FIGS. 3*a-d*, different momentary pictures on feeding an object to a receiver unit in the form of a pocket with a controllable narrowing element, wherein a folded product is already located in the pocket and wherein the opening width in the middle region is reduced to zero.
Figure 5D:
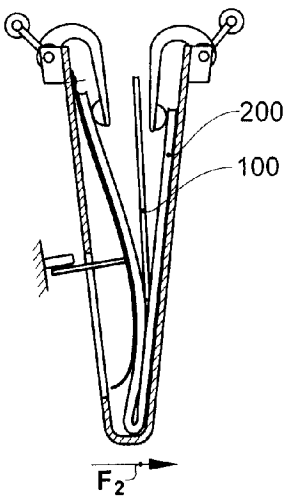
Figure 5C:
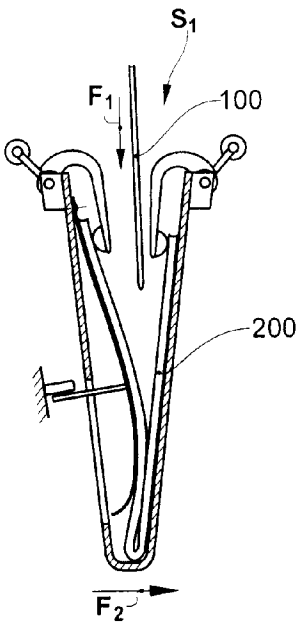
Figure 5B:
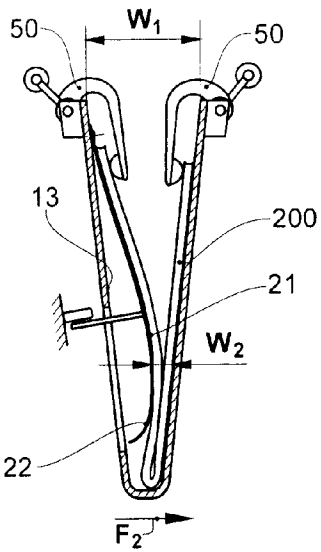
Figure 5A:
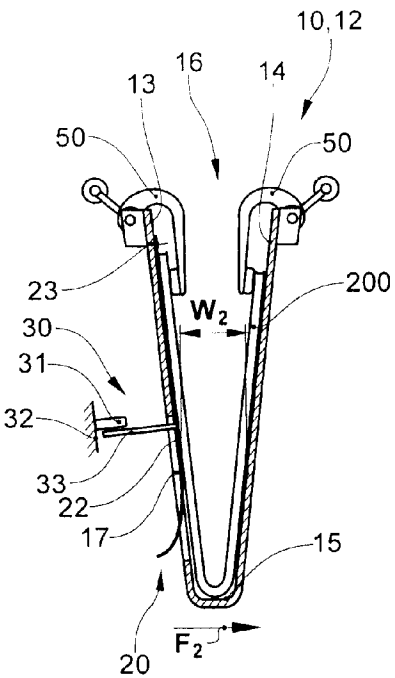

FIGS. 5*a-e* analogously to FIGS. 3*a-d*, show different momentary pictures on feeding an object 100 to a receiver unit 10 in the form of a pocket 12, in which an already folded product 200 is located. The pocket 12 and the controllable narrowing element 20 are constructed as in FIGS. 3*a-d*. The narrowing element 20, here however, is preferably controlled such that the effective opening width which is "seen" from the objects to be introduced 100, is reduced to zero in the middle region. The distance W2 between the active surface 21 and the oppositely lying support wall 14 therefore in the active condition corresponds to the thickness of the already introduced product 200 (FIGS. 5*b-d*).

The object 100 to be received afresh is therefore braked in the wedge-like entry gap which tapers to zero and is formed by way of the already received object 200 (FIG. 5*d*). The wedge shape of the entry gap is particularly advantageous for thinner objects 100 which are to be introduced, since the object 100 is braked in a gentle manner and subsequently gets stuck in the gap. Subsequently the opening width W2 is increased again, and specifically to the original opening width (as in FIG. 5*a*) in the active condition of the narrowing element 20, or to an opening width (FIG. 5*e*) which is reduced compared to this. The object 100 slides to the base of the pocket 12 on account of its residual momentum and/or on account of the gravity. Thus, a reliable braking of the object 100 is achieved, as in the case of the only partly reduced effective opening width (i.e. not reduced completely to zero)

As with FIGS. 3*a-d*, here too, the outer edges of the already introduced product 200 are clamped by the holding elements 50. The distance of the product parts in the region of the entry opening is, therefore, not changed by way of the narrowing in the middle region.

The pocket then, as shown in FIGS. 5*a-e*, may be completely narrowed when the object 100 is inserted into an empty pocket, in which no main product 200 is contained. The entry gap which tapers in a wedge-like manner in this case is formed by the pocket walls 13, 14 or the active surface 21 of the narrowing element 20, which merges into one of the pocket walls 13 in a preferably stepless manner.

It is noted that embodiments where already a first product is transported to the take-over location and completed with a further product coming from the feed unit, as e.g. shown and described in FIGS. 3*a-d*, 4*a-b* and 5*a-e*, the first product is advantageously conveyed in a conveying direction to the take-over location by means of a gripper of a gripper conveyor. Furthermore, the first product is advantageously conveyed away from the take-over location after the transfer together with the further product supplied from the feed unit in a conveying direction by the same gripper of the gripper conveyor.

In this case the receiver units are brought together with the grippers at the take-over location and as coordinated, moved. In this connection the grippers do not have to have the function of a narrowing element as it is e.g. shown in FIG. 4*b*.

In embodiments, where a first product is fed form a feed unit to the take-over location, as it is e.g. described and shown in connection with FIGS. 1*a-c* and 2*a-c*, the first product transferred form the feed unit is advantageously gripped by an empty gripper of a gripper conveyor and conveyed away from the take-over location in a conveying direction. Also in this case the receiver units are brought together with the (empty) grippers at the take-over location and as coordinated, moved. Also here the grippers do not have to have the function of a narrowing element as it is e.g. shown in FIG. 4*b*.

Figure 4B:
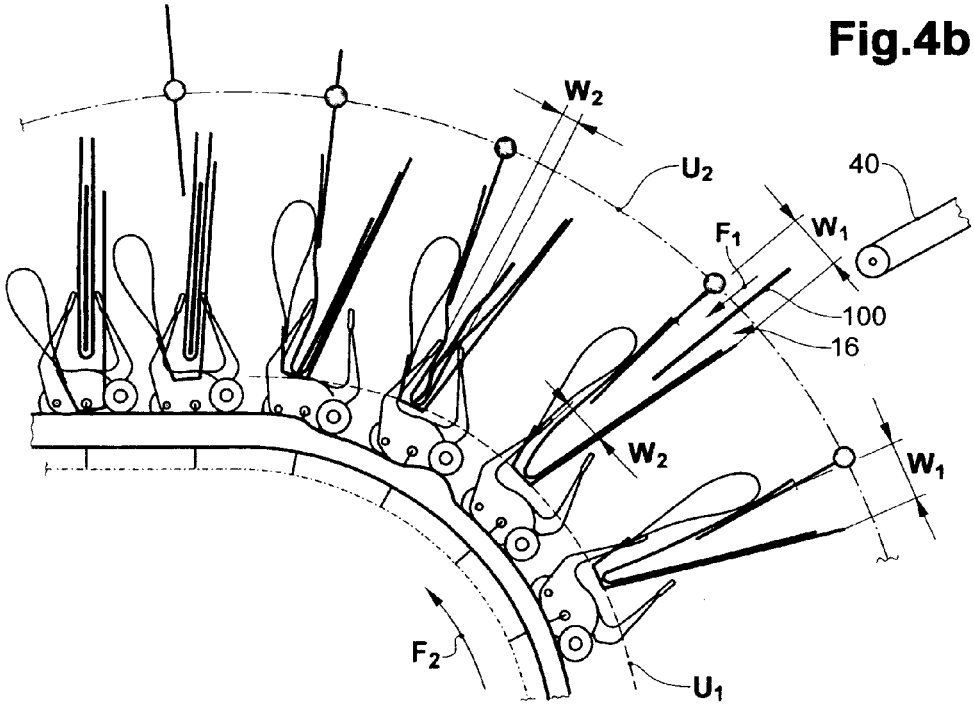

Such a gripper guideway, independent of whether the grippers have the function of a narrowing element or not, is described and shown in connection with FIGS. 4*a-b* and shall also apply for the above described explanation.

The invention claimed is:

1. A device for taking over flexible, flat objects at a take-over location, from a feed unit, comprising:

at least one receiver unit which may be moved past the take-over location, and is capable of receiving an object which is fed in a feed direction, wherein the receiver unit comprises an entry opening with an entry opening width measured transversely to the feed direction, and at least one abutment for the object edge leading in the feed direction, further comprising at least one controllable narrowing element, with which, in an active condition, the opening width of the receiver unit measured transversely to the feed direction, in a region between the entry opening and the abutment, may be reduced compared to an inactive condition, and further comprising a control device, in order to bring the narrowing element in the region of the take-over location into the active condition, wherein the entry opening width is uninfluenced by the narrowing element.

2. A device according to claim 1, wherein the region, in which the receiver unit may be narrowed by the narrowing element, lies at a distance to the abutment, which is about one quarter to two thirds of the distance of the entry opening to the abutment.

3. A device according to claim 1, wherein the narrowing element may be co-moved with the receiver unit, at least in the region of the take-over location.

4. A device according to claim 1, wherein the narrowing element is an integral component of the receiver unit.

5. A device according to claim 1, wherein the narrowing element has an active surface, whose shape and/or position may be changed in a controlled manner for changing the opening width in a region between the entry opening and the abutment, in particular by way of it comprising an elastically deformable, surfaced element.

6. A device according to claim 1, wherein the receiver unit is a pocket, which comprises two support surfaces which are arranged preferably at an acute angle relative to one another.

7. A device according to claim 6, wherein the narrowing element comprises an elastically deformable, surfaced element, which forms an active surface with a changeable shape and is mounted on one of the support surfaces.

8. A device according to claim 6, wherein the support surface and the active surface, seen in the feed direction, merge into one another in a stepless manner in the region of the entry opening, and wherein the active surface in the middle region between the entry opening and the abutment has a variable distance to the oppositely lying support surface.

9. A device according to claim 1, wherein the receiver unit comprises several separate support elements which are synchronized movable, and which cooperate with one another at least in the region of the take-over location in a manner such that at least one lateral support surface as well as an abutment are formed for receiving an object.

10. A device according to claim 1, wherein the narrowing element is realised by a gripper, which in the region of the take-over location may be moved synchronously with the receiver units, and comprises a first and a second gripper jaw, whose position relative to one another may be changed for changing the opening width of the receiver unit in a region between the entry opening and the abutment.

11. A device according to claim 1, wherein the narrowing element is capable of reducing the opening width of the receiver unit, in a region between the entry opening and the abutment, essentially to zero.

12. A method for taking over flexible, flat objects, comprising the following steps:

moving at least one receiver unit which has an entry opening with an entry opening width measured transversely to the feed direction, at least one support surface for the surfaced support of the object, and at least one abutment for the object edge leading in the feed direction, past a take-over location;

co-moving a narrowing element with the receiver unit, at least in the region of the take-over location, wherein the narrowing element in an active condition, may reduce the opening width of the receiver unit, measured transversely to the feed direction, in a region between the entry opening and the abutment, with respect to an inactive condition;

introducing the objects in the feed direction into the at least one receiver unit;

activating the narrowing element in the region of the take-over location by way of a control device;

wherein the entry opening width is uninfluenced by the narrowing element.

13. A method according to claim 12, wherein the narrowing element is deactivated again as soon as the object has been received in the receiver unit.

14. A method according to claim 12, wherein displacing, rotating, pivoting and/or elastic deformation of an active surface of the narrowing element in the region of the take-over location, changes the opening width in a region between the entry opening and the abutment.

15. A method according to claim 12, wherein the receiver unit is formed by way of several movable, separate support elements which are synchronized moveable, and which cooperate with one another at least in the region of the take-over location, in a manner such that at least one lateral support surface as well as an abutment are formed for receiving the object.

16. A method according to claim 12, wherein a gripper with a first and with a second gripper jaw, at least in the region of the take-over location, is co-moved with the receiver unit, and that the opening width of the receiver unit in a region between the entry opening and the abutment is changed by way of changing the position of at least one gripper jaw.

17. A method according to claim 16, wherein the taken-over object, after passing the take-over location, is conveyed further by the gripper, and the receiver unit is removed.

18. A method according to claim 12, wherein the objects at the take-over location are introduced into folded or glued products which are already contained in the receiver units.

19. A method according to claim 12, wherein the opening width of the receiver unit, which is measured transversely to the feed direction, in a region between the entry opening and the abutment, is essentially reduced to zero on introducing an object.

* * * * *